US007642733B2

(12) United States Patent
Shen et al.

(10) Patent No.: US 7,642,733 B2
(45) Date of Patent: Jan. 5, 2010

(54) DRIVING CIRCUIT FOR LIGHT EMITTING DEVICE WITH COMPENSATION MECHANISM AND DRIVING METHOD THEREOF

(75) Inventors: Yi-Lun Shen, Hsin-Chu (TW); Da-Chun Wei, Hsin-Chu (TW)

(73) Assignee: Leadtrend Technology Corp., Hsin-Chu (TW)

( * ) Notice: Subject to any disclaimer, the term of this patent is extended or adjusted under 35 U.S.C. 154(b) by 79 days.

(21) Appl. No.: 12/123,455

(22) Filed: May 19, 2008

(65) Prior Publication Data

US 2009/0284180 A1 Nov. 19, 2009

(51) Int. Cl.
*H05B 37/02* (2006.01)

(52) U.S. Cl. ..... 315/307; 315/291

(58) Field of Classification Search ..... 315/209 R, 315/225, 241 S, 247, 291, 307, 361
See application file for complete search history.

(56) References Cited

U.S. PATENT DOCUMENTS 5,942,859 A * 8/1999 Okude et al. ..... 315/291
6,288,501 B1 * 9/2001 Nakamura et al. ..... 315/307
6,914,395 B2 * 7/2005 Yamauchi et al. ..... 315/308
7,224,380 B2 * 5/2007 Yamaguchi et al. ..... 347/247

* cited by examiner

*Primary Examiner*—Douglas W Owens
*Assistant Examiner*—Jimmy T Vu
(74) *Attorney, Agent, or Firm*—Winston Hsu

(57) ABSTRACT

A light emitting device driving circuit, includes: a switch device, a comparator, a driving module, a time counting circuit and a compensation module. The switch device is turned on or off according to a control signal for controlling a driving current flowing through the light emitting device. The comparator generates a comparison result according to a reference voltage and a feedback voltage corresponding to the driving current. The driving module generates the control signal according to the comparison result. The time counting circuit controls the driving module to turn on the switch device after the switch device turns off for a predetermined time. The compensation module detects a turn on time for the switch device and a delay time between the feedback voltage reaching the reference voltage value and the control signal varying correspondingly, and adjusts the reference voltage according to the turn on time and the delay time.

12 Claims, 8 Drawing Sheets

DRIVING CIRCUIT FOR LIGHT EMITTING DEVICE WITH COMPENSATION MECHANISM AND DRIVING METHOD THEREOF

BACKGROUND OF THE INVENTION

1. Field of the Invention

The present invention relates to a light emitting device driving circuit, and particularly relates to a light emitting device driving circuit, which has a compensation mechanism.

2. Description of the Prior Art

In a conventional driving circuit for a light emitting device (for example, a light emitting diode), a PWM (Pulse Width Modulation) circuit is utilized to control a switch device for controlling the current flowing through the light emitting device. Also, a comparator is utilized to compare a reference voltage with a feedback voltage proportional to the current to determine if the current should decrease or increase. Such a technique is a well-known controlling technique called peak-current controlling technique. This technique has many disadvantages, however. For example, the current ripple based on this structure substantially varies if input voltage varies and the input voltage of the light emitting device may be unfortunately an AC voltage, so the current accuracy control and the endurance of the light emitting device may be negatively affected. Moreover, the PWM circuit operates at a fixed frequency, such that the circuit will cause stronger electromagnetic interference to other devices. Besides, an oscillation may occur if the switch device is accidentally turned on when it is expected to be off.

FIG. 1 is a circuit diagram illustrating a driving circuit of prior art for a light emitting device. As shown in FIG. 1, the light emitting device driving circuit 100 includes a comparator 101, a driving module 103 and a time counting circuit 105. The comparator 101 compares a feedback voltage $V_{fb}$ (which is generated according to the resistor 108 and a driving current I) and a reference voltage $V_{ref}$, and controls the driving module 103 to output a control signal VG for controlling the switch device 107, thereby controlling the current I flowing through the light emitting device 109 and the inductor 111. The light emitting device driving circuit 100 further includes a time counting circuit 105 that controls the driving module 103 such that the switch device 107 will be turned on again after being turned off for a predetermined period of time. The resistor 106 is used to adjust the predetermined period of time, and such a technique is a well-known skill called constant-off time.

The advantage of this method is that, since the turn off time is constant, the range of the current ripple will not change as input voltage changes, and the problem of poor current accuracy may be avoided. Also, since the operation frequency of the PWM circuit in FIG. 1 is not fixed, the circuit will cause less electromagnetic interference problem. Furthermore, since the decreasing rate of the driving current is almost fixed, switch device 107 may not be accidentally turned on, avoiding the above-mentioned problem of oscillation.

However, the structure in FIG. 1 may have some problems. FIG. 2 illustrates a current-time relation of the driving circuit of prior art for a light emitting device. As shown in FIG. 2, the maximum value of the current I is originally set to be $I_{SU}$. In view of signal propagation, the circuit in FIG. 1 always has a delay time starting at the time when the feedback voltage $V_{fb}$ reaches the reference voltage $V_{ref}$ and ending at the time when the control signal VG really turns off switch device 107. Thus, during the delay time, current I will exceed the originally-set $I_{SU}$ and finally reach $I_{max}$. As mentioned before, the turn off time $t_{off}$ is set as a constant such that $I_{min}$ is a function of $I_{max}$. Thus, the real mean driving current ($=(I_{max}+I_{min})/2$) will exceed the expected mean driving current $I_{mean}$ ($\sim(I_{max}+I_{min})/2$). The difference between the real and expected mean driving currents implies driving current inaccuracy. The larger the input voltage Vin, the more significant the driving current inaccuracy.

SUMMARY OF THE INVENTION

One embodiment of the present invention discloses a light emitting device driving circuit with a compensation mechanism. The light emitting device driving circuit is used for driving at least one light emitting device and includes a switch device, a comparator, a driving module, a time counting circuit and a compensation module. The switch device is controlled by a control signal, and is for controlling a driving current flowing through the light emitting device. The comparator is for generating a comparison result according to a reference voltage and a feedback voltage corresponding to the driving current. The driving module is used for generating the control signal according to the comparison result. The time counting circuit is used for controlling the driving module to turn on the switch device again after the switch device is turned off for a predetermined time. The compensation module is used for detecting a turn on time for the switch device and a delay time between the feedback voltage reaching the reference voltage value and the control signal varying correspondingly, and is used for adjusting the reference voltage according to the turn on time and the delay time.

According to the above-mentioned embodiments, since the turn off time of the switch device is fixed such that the current ripple will not vary corresponding to different input voltages, the problem of poor current accuracy will not occur. Also, the operation frequency of the PWM circuit is not fixed, thus the circuit has better electromagnetic protection ability. Moreover, since the discharging slope of the driving current is fixed, the problem of oscillation due to the switch device turning on before the ideal turn off time of the switch device is reached will not occur. Additionally, the problem of poor current accuracy due to a non-ideal circuit delay time can be compensated for.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3 (*b*) illustrates a current-time relation of a light emitting device driving circuit according to the present invention.

DETAILED DESCRIPTION

Figure 1:
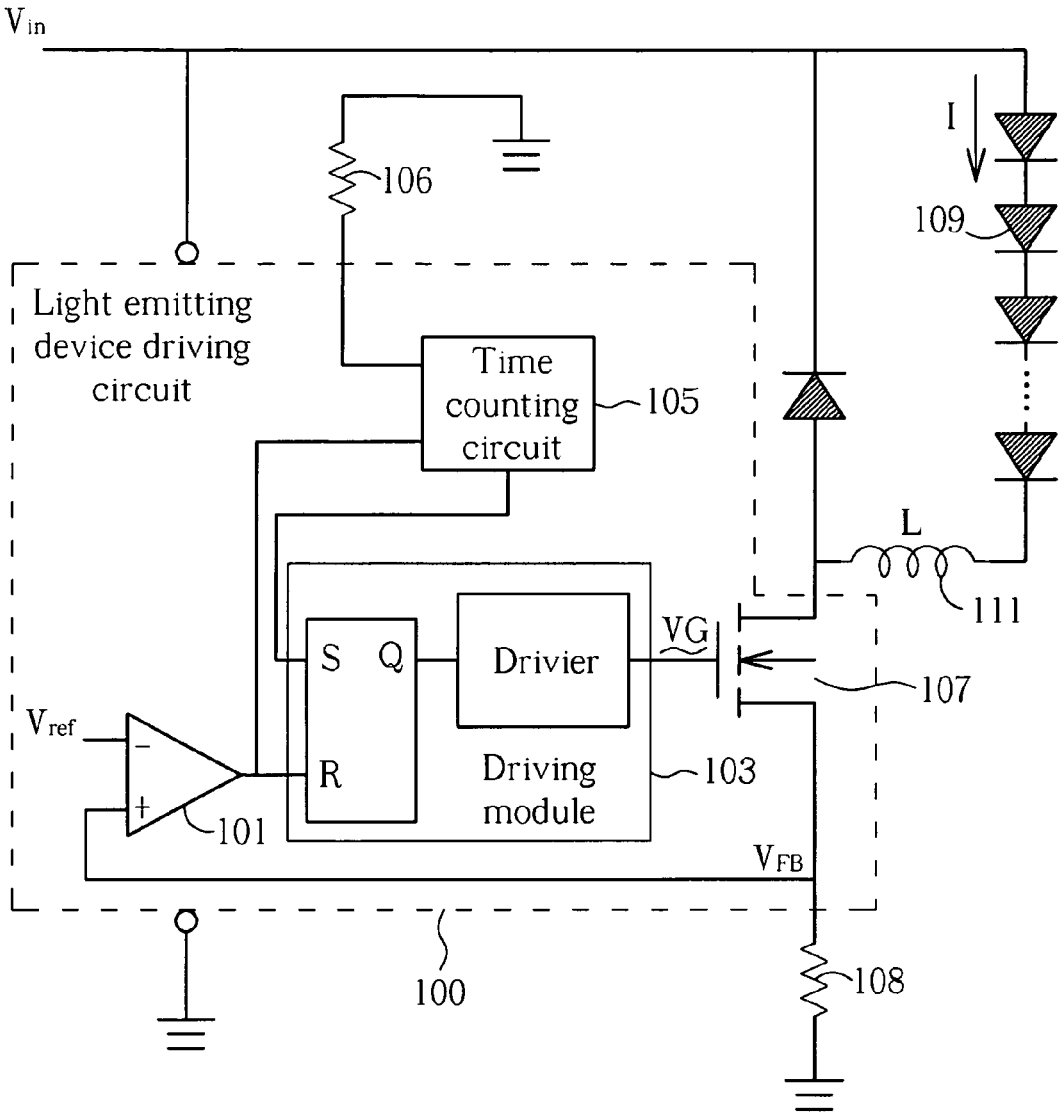
FIG. 1 PRIOR ART
FIG. 1 is a circuit diagram illustrating a prior art driving circuit for a light emitting device.
Figure 2:
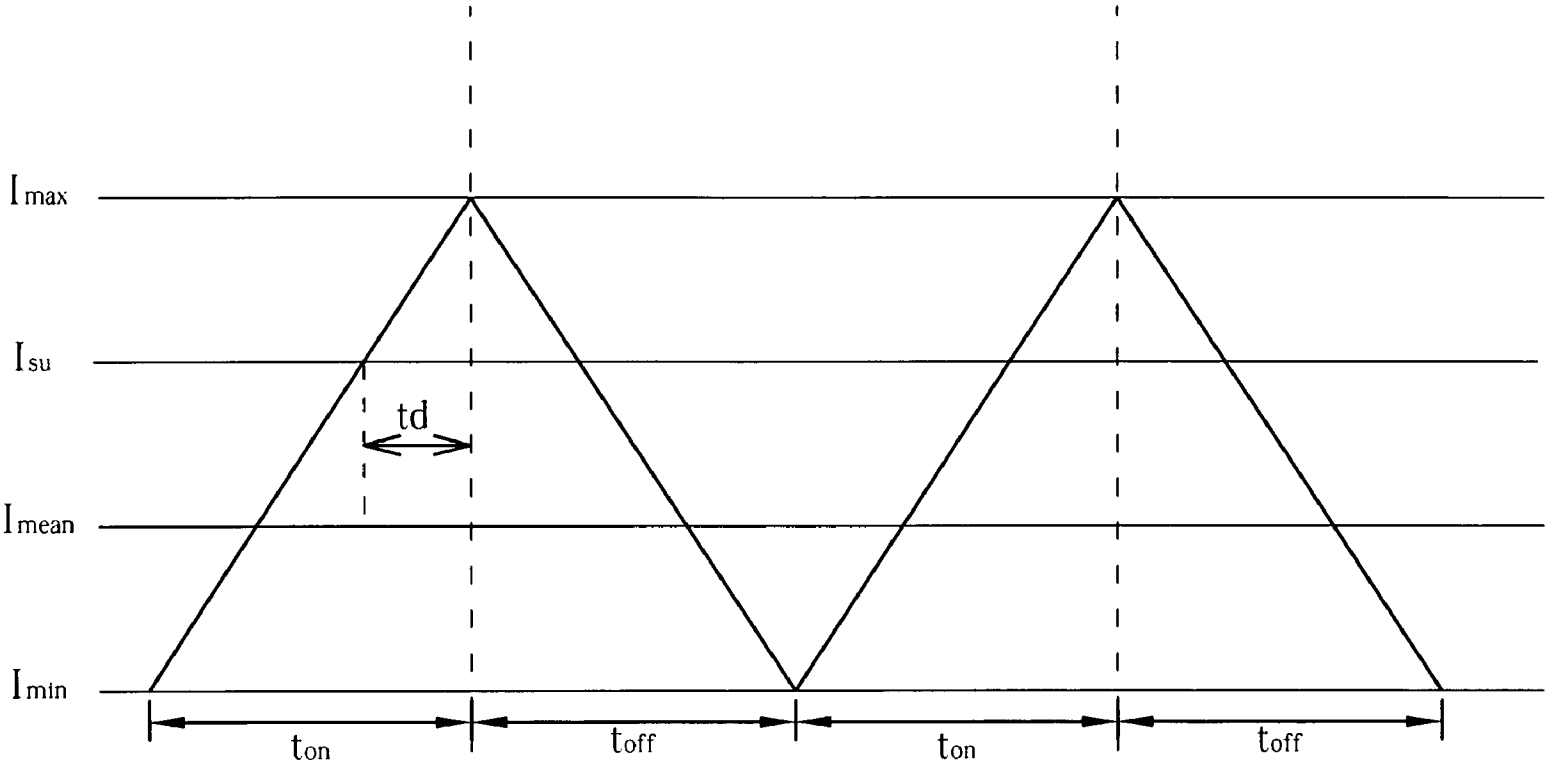
FIG. 2 PRIOR ART
FIG. 2 illustrates a current-time relation of the prior art driving circuit for a light emitting device.
Figure 3A:
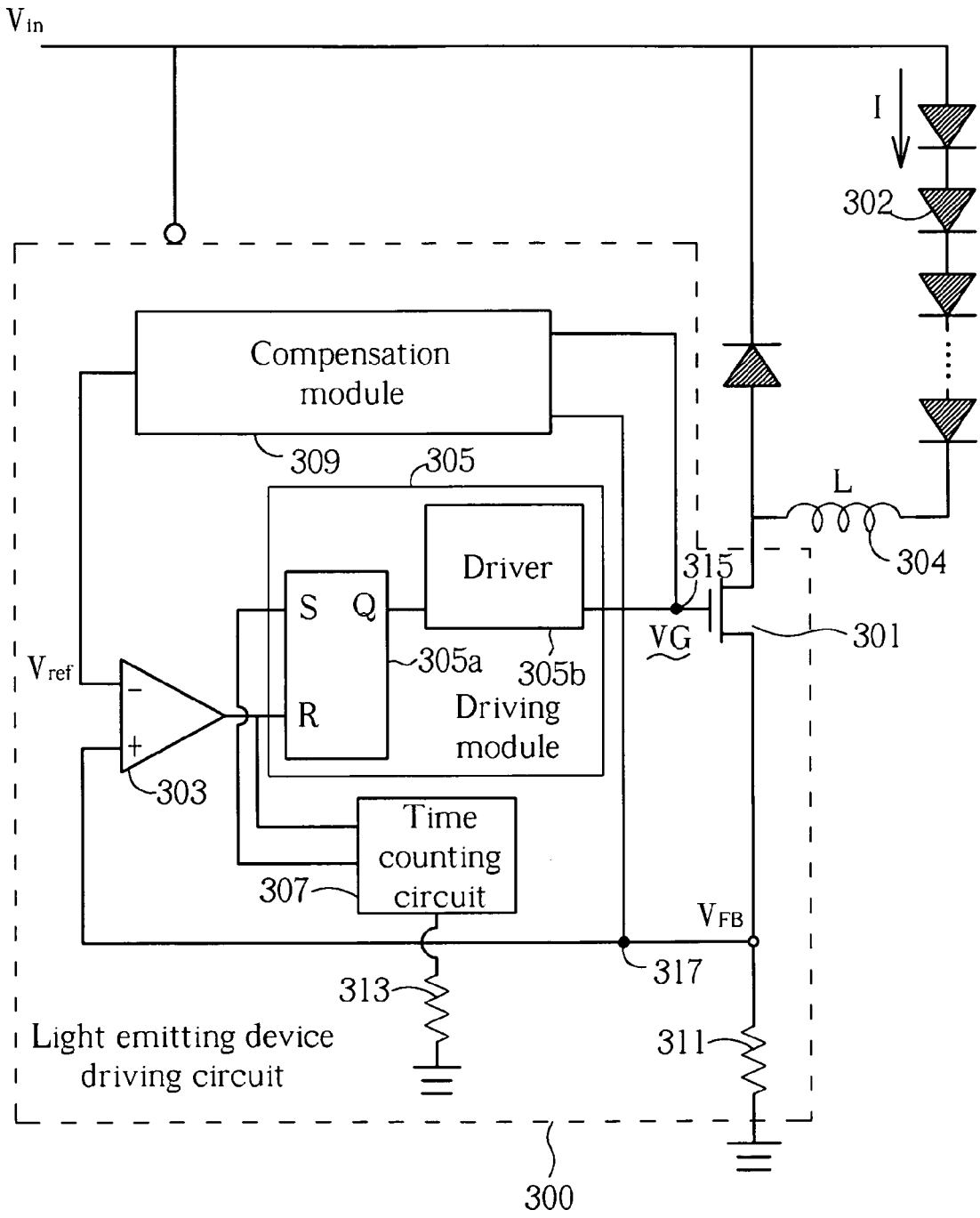
FIG. 3(*a*) is a circuit diagram illustrating a light emitting device driving circuit according to a preferred embodiment of the present invention.
Figure 3B:
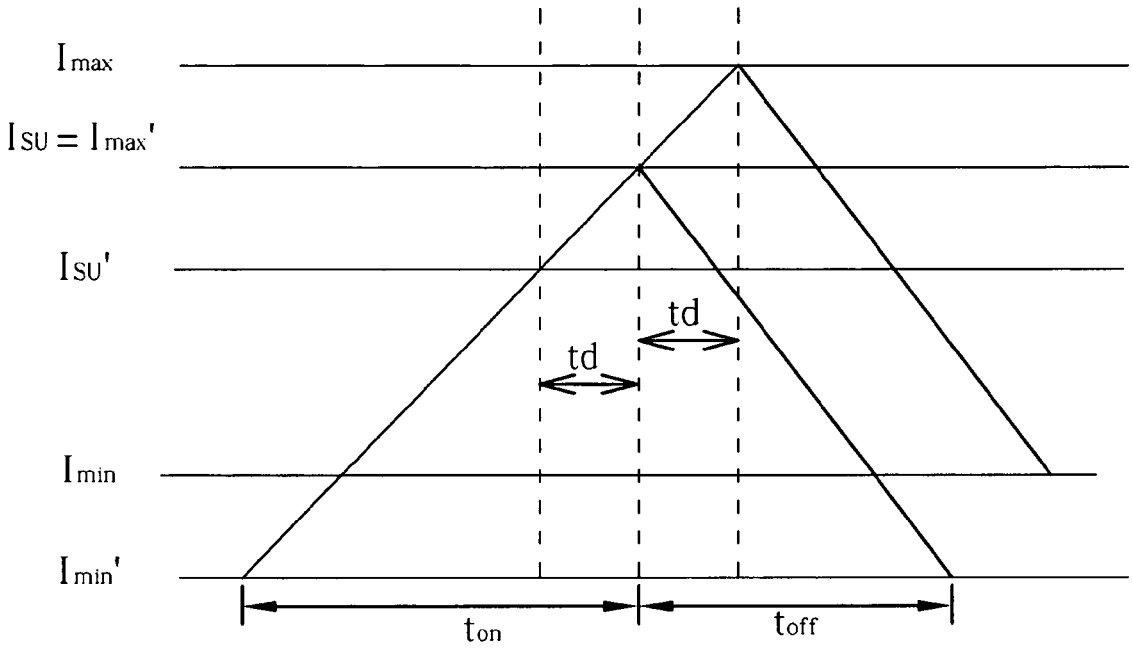

FIG. 3(*a*) is a circuit diagram illustrating a light emitting device driving circuit according to a preferred embodiment of the present invention. As shown in FIG. 3(*a*), the light emitting device driving circuit 300 is used for driving a light emitting device 302 (i.e. providing a driving current I to the light emitting device 302). Light emitting device driving circuit 300 includes a switch device 301, a comparator 303, a driving module 305, a time counting circuit 307, and a compensation module 309. The switch device 301 is a power transistor in this embodiment. The driving module 305 is used for generating a control signal VG that determines if the switch device 301 is on or off and controls the driving current I flowing through the light emitting device 302. Thus, the driving current I flowing through the light emitting device 302 is determined once the duty cycle of the control signal VG is determined. The current flowing through the resistor 311 can generate a feedback voltage $V_{FB}$ accordingly, which represents the driving current I as the current flowing through the resistor 311 is in direct proportion to the driving current I.

The comparator 303 generates a comparison result (the output signal) according to a reference voltage $V_{ref}$ and a feedback voltage $V_{FB}$, and the driving module 305 generates the control signal VG according to the comparison result. In this embodiment, the driving module 305 includes, but is not limited to, a flip-flop 305*a* and a driver 305*b*. The driving ability of an output signal of the flip-flop 305*a* is increased via the driver 305*a* so that control signal VG having increased driving ability can drive the switch device 301.

After the switch device 301 is turned on, the feedback voltage $V_{FB}$ gradually increases as the driving current I gradually increases. The logic level of an output signal of the comparator 303 changes from low to high when the feedback voltage $V_{FB}$ reaches or exceeds a reference voltage $V_{ref}$, such that a reset input terminal R of the flip-flop 305*a* is triggered. Both the logic level of an output signal of the flip-flop 305*a* and the logic level of the control signal VG change from high to low accordingly, such that the switch device 301 is turned off. Additionally, the output signal of the comparator 303 having a high logic level triggers the time counting circuit 307 to start counting at the moment when the feedback voltage $V_{FB}$ reaches or exceeds the reference voltage $V_{ref}$. After counting for a predetermined period of time, the time counting circuit 307 outputs an output signal with a high logic level to set the flip-flop 305*a*, and the logic level of the output signal of the flip-flop 305*a* changes from low to high, such that the switch device 301 is turned on again. The predetermined period of time means a constant off time and the resistor 313 is used for adjusting the length of the constant off time.

The driving module 305, the comparator 303 and the time counting circuit 307 can be referenced together as a control circuit to generate the control signal for controlling the switch device 301.

The module 309 is used for detecting a turn on time $t_{on}$ of the switch device 301 and a delay time $t_d$ caused by the comparator 303 and the driving module 305 (i.e. a delay time starting at the moment when the feedback voltage $V_{FB}$ reaches the reference voltage $V_{ref}$, and ending at the moment when the logic level of the control signal VG changes from high to low). Also, a compensated reference voltage $V_{csref}$ is computed to replace reference voltage $V_{ref}$ according to the ratio of the turn on time $t_{on}$ and the delay time $t_d$.

Please refer to FIG. 3(*b*). The expected value of the driving current I is $I_{SU}$, but the driving current I will exceed the value $I_{SU}$ and reach the value $I_{max}$ due to the delay time $t_d$. Accordingly, if the reference voltage value of the comparator 303 decreases, the expected value of the driving current I may decrease to $I_{su}'$. Nevertheless, due to the delay time $t_d$, the real driving current I will exceed the value of $I_{SU}'$ and reach the value of $I_{max}'$. Therefore, the value of $I_{SU}$ can be designed to be equal to the value of $I_{max}'$. In this way, the effect of the delay time td can be eliminated. Equations (1)~(3) as follows describe the computing process of the reference voltage:

$$\Delta I_{ripple} = I_{max} - I_{min} = \frac{V_{leds}}{L} t_{off} \quad \text{Equation (1)}$$

$$\frac{V_{csref}}{R_{sns}} = \frac{V_{ref}}{R_{sns}} - t_d \times \frac{CR_1 I_{mean}}{t_{on}} \quad \text{Equation (2)}$$

$$V_{csref} = V_{ref} - \frac{V_{ref}}{CR_2 I_{mean}} \times t_d \times \frac{CR_1 I_{mean}}{t_{on}} \quad \text{Equation (3)}$$

wherein equation (1) indicates the current ripple, $V_{leds}$ is the voltage of the light emitting device 302 in FIG. 3, L is the inductance of the inductor 304, and $t_{off}$ is turn off time of the switch device 301. In equation (2), $V_{ref}$ is an original reference voltage, $V_{csref}$ is a compensated reference voltage, $R_{sns}$ is the resistance of the resistor 311, and $I_{mean}$ is an average current equal to $(I_{max}+I_{min})/2$). $CR_1$ is a first reference constant relative to the current ripple. For example, if the current ripple is forecast to be +/−20%, then $CR_1$ is 0.4. Similarly, if the current ripple is forecast to be +/−30%, then $CR_1$ is 0.6, etc. Also, equation (3) can be derived from equation (2). In equation (3), $CR_2$ is a second reference constant relative to the current ripple. For example, if the current ripple is forecast to be +/−20%, then $CR_2$ is 1.2. Similarly, if the current ripple is forecast to be +/−30%, then $CR_2$ is 1.3, and so on.

An example is provided, given the conditions of Vref=0.25V and current ripple=+/−20%. The above-mentioned equations (1), (2), and (3) are changed to be:

$$\Delta I_{ripple} = I_{max} - I_{min} = \frac{V_{leds}}{L} t_{off} \quad \text{Equation (1)}$$

$$\frac{V_{csref}}{R_{sns}} = \frac{0.25}{R_{sns}} t_d \times \frac{0.4 I_{mean}}{t_{on}} \quad \text{Equation (2)}$$

$$V_{csref} = 0.25 - \frac{0.25}{1.2 I_{mean}} \times t_d \times \frac{0.4 I_{mean}}{t_{on}} = 0.25 - 0.0833 \times t_d \times \frac{1}{t_{on}} \quad \text{Equation (3)}$$

According to equation (3), $V_{csref}$ is relative to the ratio between the turn on time $t_{on}$ and delay time $t_d$. Therefore, once the ratio between the turn on time $t_{on}$ and delay time $t_d$ is obtained, $V_{csref}$ can be determined and no other variables are needed.

Figure 4:
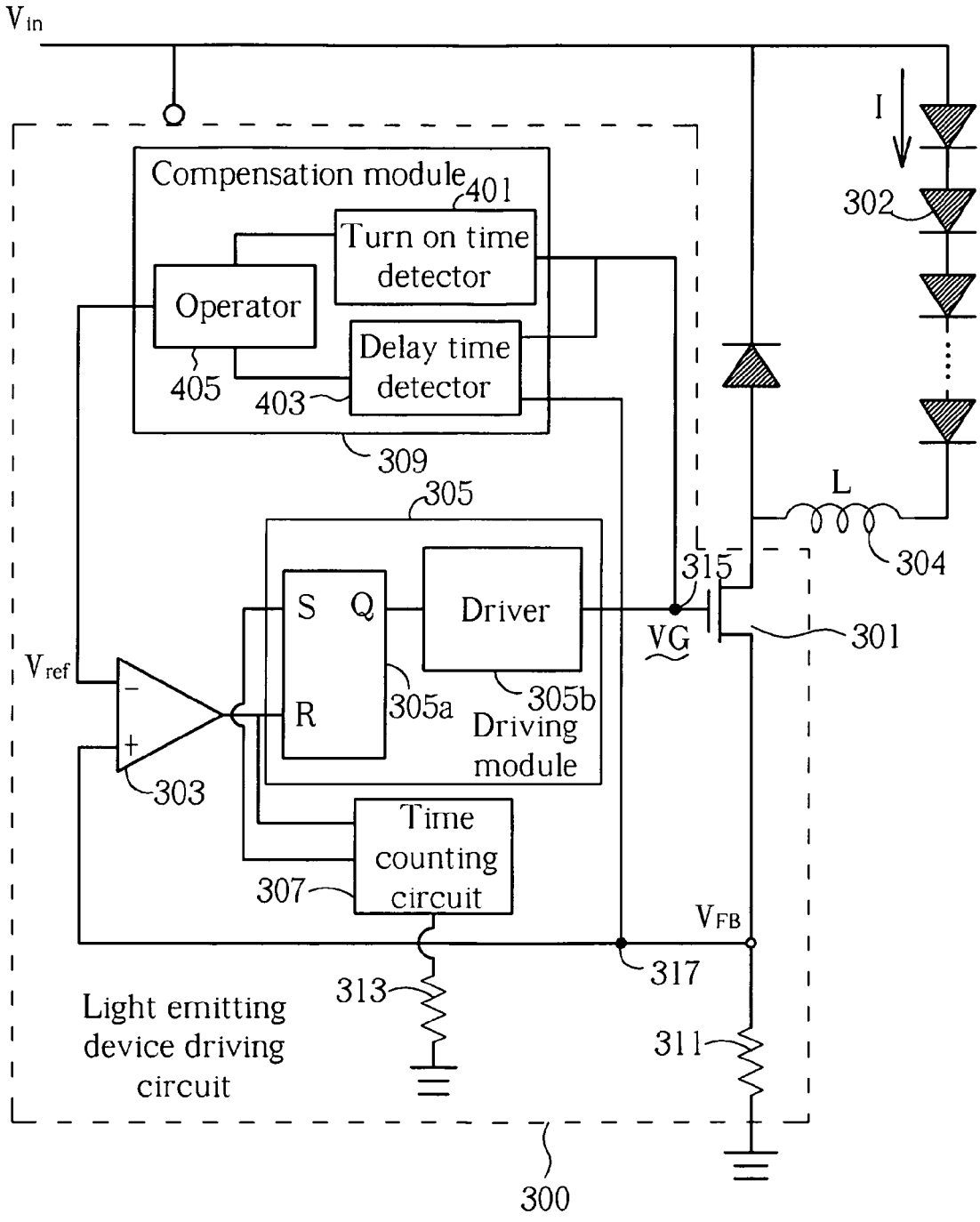
FIG. 4 is a detailed circuit diagram illustrating a light emitting device driving circuit according to a preferred embodiment of the present invention.

FIG. 4 is a detailed circuit diagram illustrating a light emitting device driving circuit according to a preferred embodiment of the present invention. As shown in FIG. 4, the compensation module 309 includes a turn on time detector 401, a delay time detector 403 and an operator 405. The turn on time detector 401 is used for generating a turn on time parameter, the delay time detector 403 is used for generating a delay time parameter, and the operator 405 is used for generating $V_{csref}$ to adjust or update the reference voltage $V_{ref}$ according to the turn on time parameter and the delay time parameter.

Figure 5:
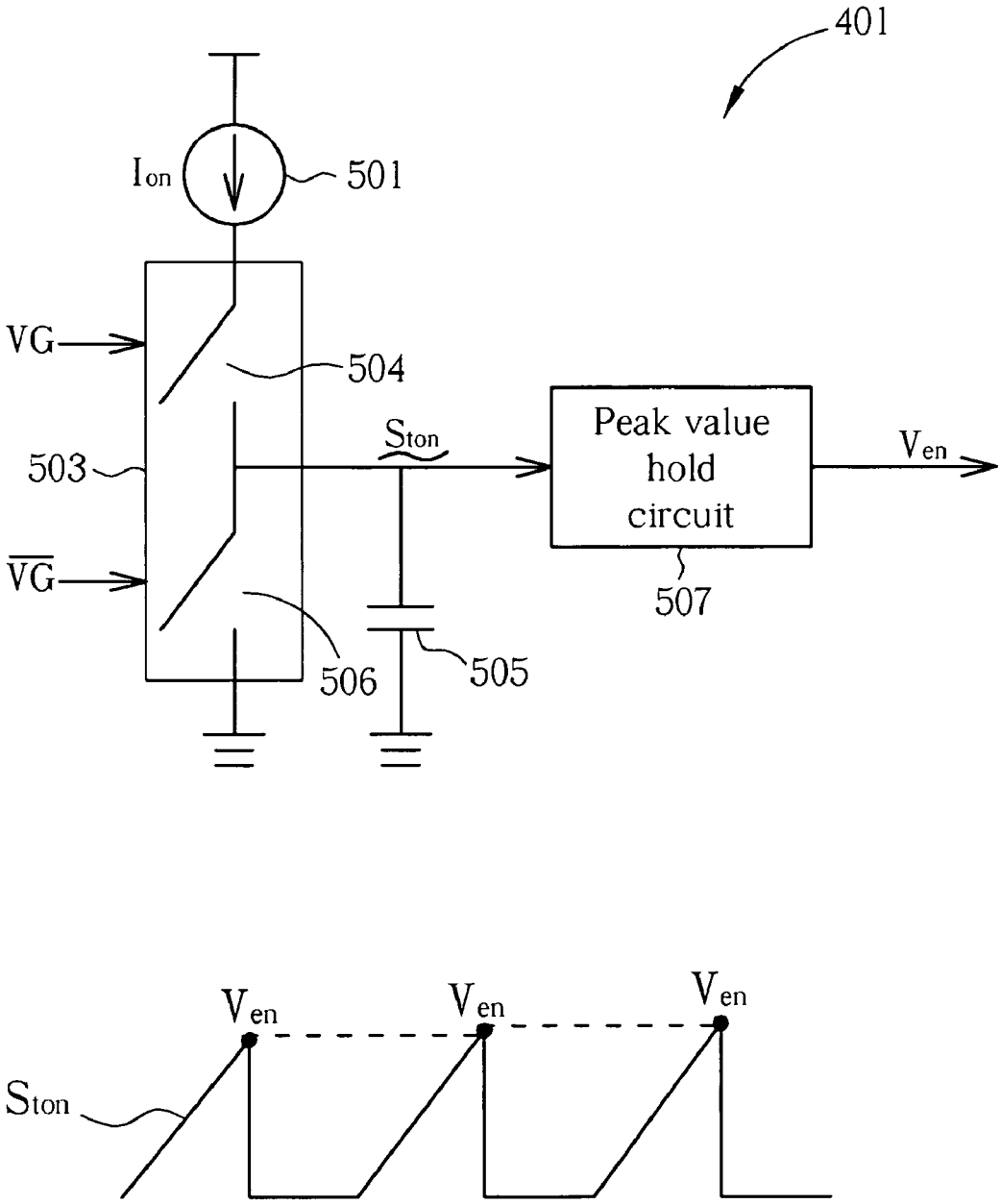
FIG. 5 is a schematic diagram illustrating an example of the turn on time detector shown in FIG. 4 and the operation thereof.

FIG. 5 is a schematic diagram illustrating an example of the turn on time detector shown in FIG. 4 and the operation thereof. In this, embodiment, the turn on time detector 401 includes a current source 501, a switch module 503, a capacitor 505 and a peak value hold circuit 507. The current source 501 is used for providing a predetermined current $I_{on}$. The control signal VG turns on the switch 504 when the switch device 303 turns on, such that the capacitor 505 is charged by the current $I_{on}$. The control signal VG turns on the switch 506 when the switch device 301 turns off, such that the capacitor 505 is discharged. Thus, as charging current $I_{on}$ and capacitance of capacitor 505 are two known constants, it can be derived that the peak voltage on capacitor 505 is in proportion to the turn on time of switch device 303. The peak value hold circuit 507 samples the peak value of the voltage on capacitor 505, equivalent to the turn on time parameter signal $S_{ton}$, to generate the turn on time parameter. In this embodiment, the peak value hold circuit 507 samples the peak value of the turn on time parameter signal $S_{ton}$. The turn on time $t_{on}$ can be obtained via equation (4):

$$C_{on} \times V_{en} = I_{on} \times t_{on} \rightarrow t_{on} = \frac{C_{on} \times V_{en}}{I_{on}} \quad \text{Equation (4)}$$

wherein $C_{on}$ is a value of the capacitor 505, and $V_{en}$ is a peak voltage. Via this equation, the turn on time $t_{on}$ can be obtained.

Figure 6:
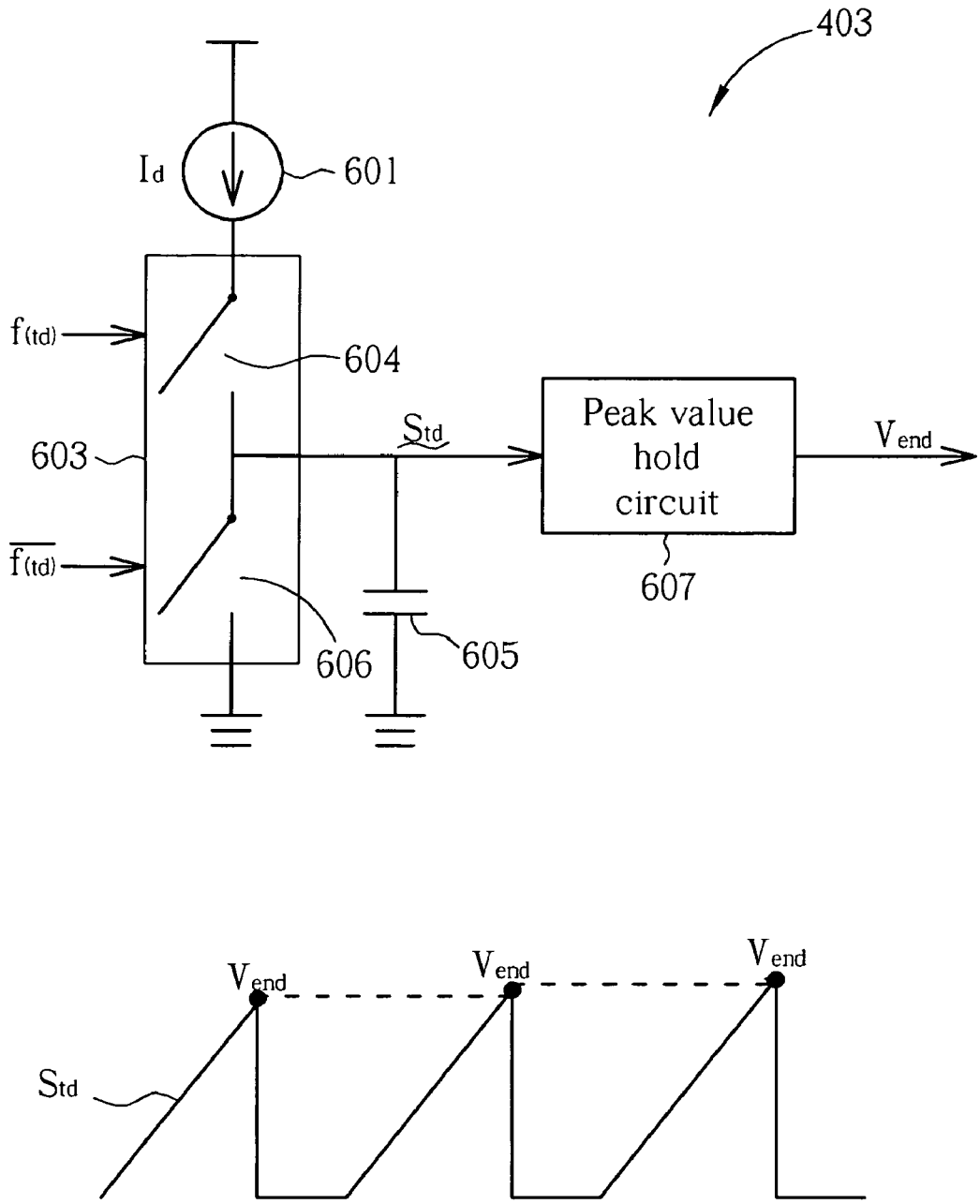
FIG. 6 is a schematic diagram illustrating an example of the delay time detector shown in FIG. 4 and the operation thereof.

FIG. 6 is a schematic diagram illustrating an example of the delay time detector shown in FIG. 4 and the operation thereof. In this embodiment, the delay time detector 403 includes a current source 601, a switch module 603, a capacitor 605 and a peak value hold circuit 607. Since the operation thereof is the same as that of the circuit shown in FIG. 5, it is omitted for brevity. Please refer to FIG. 3(*a*), since the voltage signals on the connection points 315 and 317 cannot directly control the switch module 603, the delay time detector 403 should further include a delay time function signal generating circuit (not illustrated). A delay function signal $f(t_d)$ can be generated according to the delay time $t_d$ to control the switch module 603. The delay function signal $f(t_d)$ can be generated according to the following steps: comparing the feedback voltage $V_{FB}$ and the reference voltage $V_{ref}$ to obtain a comparison result; and performing an exclusive OR operation on the comparison result and the control signal VG, such that the delay function signal $f(t_d)$ can be generated.

The delay time td can be obtained according to the following equation:

$$C_d \times V_{end} = I_d \times t_d \rightarrow t_d = \frac{C_d \times V_{end}}{I_d}$$

wherein $C_d$ is a value of the capacitor 605 Equation (5) lue voltage (i.e. the delay time parameter). Via equations (3), (4) and (5), the compensated reference voltage $V_{csref}$ can be obtained, as shown in Eq. (6).

$$V_{csref} = 0.25 - 0.0833 \times \frac{V_{end}}{V_{en}} \times \frac{C_d}{C_{on}} \frac{I_{on}}{I_d} \quad \text{Equation (6)}$$

The operator 405 generates the compensated reference voltage value according to relative parameters of the equation (6) to adjust or update $V_{ref}$.

Figure 7:
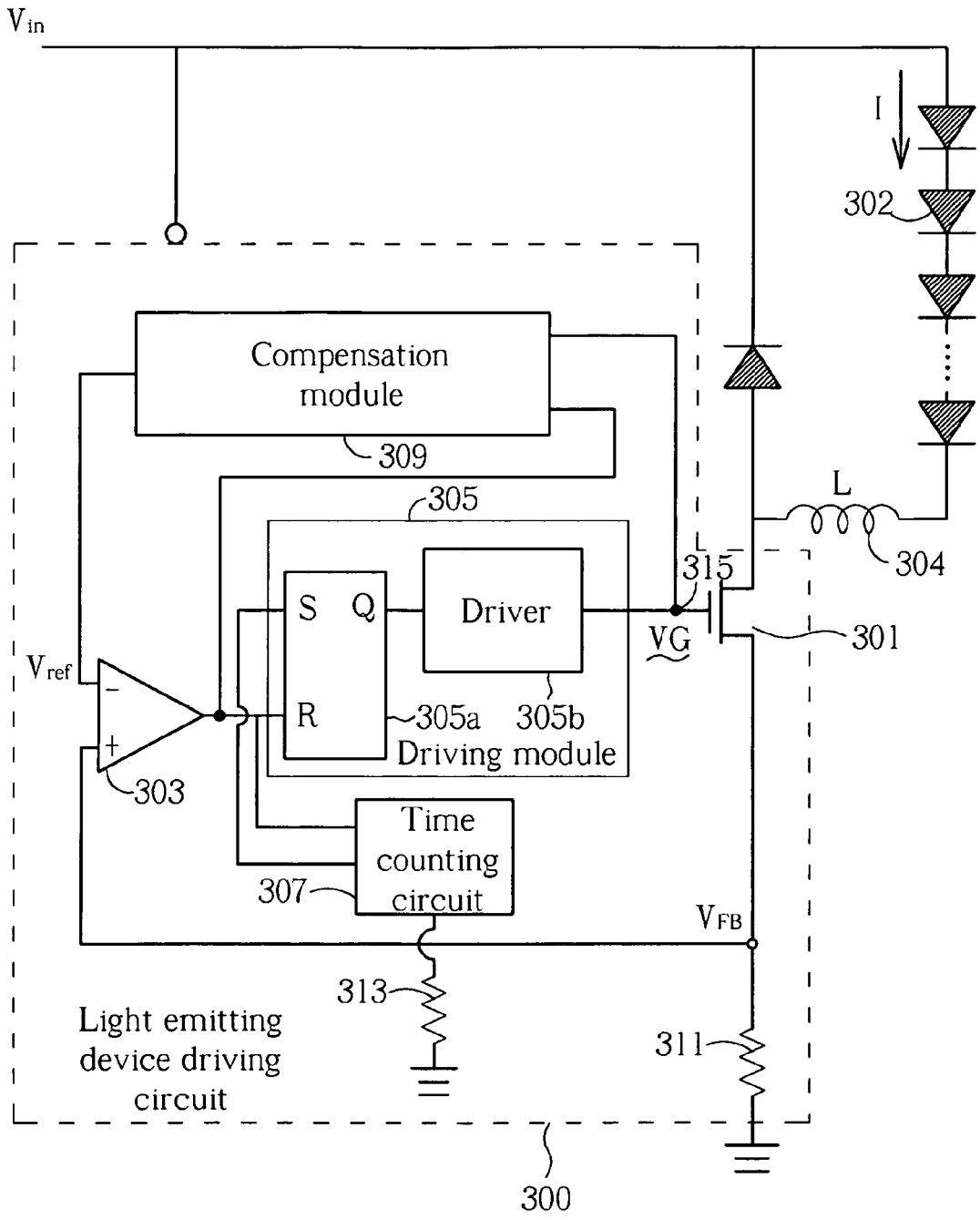
FIG. 7 is a circuit diagram illustrating another driving circuit for a light emitting device according to a preferred embodiment of the present invention.

In FIG. 3(*a*), the compensation module 309 directly detects the feedback voltage $V_{FB}$. Instead, It may directly detect the comparison result of the comparator 303, as shown in FIG. 7. The signal delay time measured in FIG. 7 may only include a signal delay time contributed by the driving module 305 but excludes that contributed by the comparator 303. If the signal delay time contributed by the comparator 303 is much smaller than that by the driving module 305, the signal delay time contributed by the comparator 303 can be ignored and the signal delay time of the driving module 305 can be directly utilized as the delay time $t_d$. Otherwise, if the signal delay time of the comparator 303 cannot be ignored, the signal delay time of the driving module 305 can add an offset to generate the desired delay time $t_d$.

It should be noted that the structures shown in FIG. 5 and FIG. 6 are only examples and are not meant to limit the scope of the present invention. Other structures that can perform the same function and also fall within the scope of the present invention. Also, according to the above-mentioned embodiments, a corresponding light emitting device driving method can be obtained. The steps of the method can be described as follows: comparing a reference voltage and a feedback voltage corresponding to a driving current flowing through the light emitting device to generate a comparison result; generating a control signal according to the comparison result; turning on or off a switch device according to the control signal to control the driving current; turning on the switch device after the switch device is turned off for a predetermined time; and detecting a turn on time of the switch device and a delay time starting at the time when the feedback voltage reaches the reference voltage value and ending at the time when the control signal varies correspondingly, and adjusting the reference voltage according to the turn on time and the delayed time. Other detailed characteristics are already disclosed in the above-mentioned embodiments, and are therefore omitted here for brevity.

According to the above-mentioned embodiments, since the turn off time of a switch device is fixed and the range of the current ripple does not vary corresponding to different input voltages, the problem of poor current accuracy will not occur. Also, the operation frequency of the PWM circuit is not fixed, thus the circuit causes less electromagnetic interference. Furthermore, since the discharging slope of the driving current is fixed, the problem of oscillation due to unexpected turn-on of the switch device will not occur. Additionally, the problem of poor current accuracy due to signal propagation delay time can be compensated. Also, the reference voltage adjusted is relevant to the ratio between sampled peak voltages, and is not affected by other variables. In addition, the compensation mechanism does not need extra pins, simplifying the required device number and design.

Those skilled in the art will readily observe that numerous modifications and alterations of the device and method may be made while retaining the teachings of the invention.

What is claimed is:

1. A light emitting device driving circuit with a compensation mechanism, the light emitting device driving circuit being used for driving at least one light emitting device and comprising:

a switch device, controlled by a control signal, for controlling a driving current flowing through the light emitting device;

a comparator, for generating a comparison result according to a reference voltage and a feedback voltage corresponding to the driving current;

a driving module, for generating the control signal according to the comparison result;

a time counting circuit, for controlling the driving module to turn on the switch device after the switch device turns off for a predetermined time; and a compensation module, for detecting a turn on time of the switch device and a delay time starting at the time when the feedback voltage reaches the reference voltage value and ending at the time when the control signal varies correspondingly, the compensation module adjusting the reference voltage according to the turn on time and the delay time.

2. The light emitting device driving circuit with compensation mechanism of claim 1, wherein the compensation module adjusts the reference voltage according to a ratio between the turn on time and the delay time.

3. The light emitting device driving circuit with compensation mechanism of claim 1, wherein the compensation module comprises:

a turn on time detector, for generating a turn on time parameter;

a delay time detector, for generating a delay time parameter; and an operator, for adjusting the reference voltage according to the turn on time parameter and the delay time parameter.

4. The light emitting device driving circuit with compensation mechanism of claim 3, wherein the turn on time detector comprises:

a current source, for providing a predetermined current;

a switch module, coupled to the current source;

a capacitor, coupled to the switch module; and a peak value hold circuit;

wherein the switch module charges or discharges the capacitor according to the control signal to generate a turn on time parameter signal, and the peak value hold circuit samples the turn on time parameter signal to generate the turn on time parameter.

5. The light emitting device driving circuit with compensation mechanism of claim 3, wherein the delay time detector comprises:

a delay function signal generating circuit, for generating a delay function signal according to the delay time;

a current source, for providing a predetermined current;

a switch module, coupled to the current source; and a peak value hold circuit;

wherein the switch module charges or discharges the capacitor according to the delay function signal to generate a delay time parameter signal, and the peak value hold circuit samples the delay time parameter signal to generate the delay time parameter.

6. The light emitting device driving circuit with compensation mechanism of claim 1, wherein the switch device is a power transistor.

7. The light emitting device driving circuit with compensation mechanism of claim 1, wherein the light emitting device includes at least one light emitting diode.

8. The light emitting device driving circuit with compensation mechanism of claim 1, wherein the driving module comprises:

a flip-flop, changing a logic level of an output signal to turn off the switch device when the feedback voltage reaches the reference voltage value, and changing the logic level of the output signal to turn on the switch device after the switch device turns off for the predetermined time; and a driver, for generating the control signal according to the output signal of the flip-flop.

9. A light emitting device driving method with compensation mechanism, the light emitting device driving method being used for driving at least one light emitting device and comprising:

comparing a reference voltage and a feedback voltage corresponding to a driving current flowing through the light emitting device to generate a comparison result;

generating a control signal according to the comparison result;

turning on or off a switch device according to the control signal to control the driving current;

turning on the switch device after the switch device turns off for a predetermined time;

detecting a turn on time of the switch device and a delay time starting at the time when the feedback voltage reaches the reference voltage value and ending at the time when the control signal varies correspondingly; and adjusting the reference voltage according to the turn on time and the delayed time.

10. The light emitting device driving method with compensation mechanism of claim 9, wherein the step of adjusting the reference voltage adjusts the reference voltage according to a ratio between the turn on time and the delay time.

11. The light emitting device driving method with comparison mechanism of claim 9, wherein the step of adjusting the reference voltage adjusts the reference voltage according to a turn on time parameter and a delay time parameter.

12. A light emitting device driving circuit with compensation mechanism, the light emitting device driving circuit being used for driving at least one light emitting device and comprising:

a switch device, controlled by a control signal to be in a turn on state or a turn off state, for controlling a driving current flowing through the light emitting device;

a control circuit, for generating the control signal according to a reference voltage and a feedback voltage of the driving current; and a compensation module, for detecting a turn on time for the switch device in the turn on state and a delay time starting at the time when the feedback voltage reaches the reference voltage value and ending at the time when the control signal varies correspondingly, and for adjusting the reference voltage according to the turn on time and the delayed time.

* * * * *